US012029376B2

(12) United States Patent
Tsuchida

(10) Patent No.: US 12,029,376 B2
(45) Date of Patent: Jul. 9, 2024

(54) CLEANER HEAD AND VACUUM CLEANER

(71) Applicant: Mitsubishi Electric Corporation, Tokyo (JP)

(72) Inventor: Kazuchika Tsuchida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 288 days.

(21) Appl. No.: 17/611,989

(22) PCT Filed: Jun. 7, 2019

(86) PCT No.: PCT/JP2019/022742
§ 371 (c)(1),
(2) Date: Nov. 17, 2021

(87) PCT Pub. No.: WO2020/246026
PCT Pub. Date: Dec. 10, 2020

(65) Prior Publication Data
US 2022/0248921 A1 Aug. 11, 2022

(51) Int. Cl.
*A47L 9/04* (2006.01)

(52) U.S. Cl.
CPC ..... *A47L 9/0477* (2013.01); *A47L 9/0411* (2013.01); *A47L 9/0444* (2013.01)

(58) Field of Classification Search
CPC ..... A47L 5/30; A47L 9/0427; A47L 9/0411; A47L 9/0477; A47L 2201/06; A47L 9/04; A47L 9/0405
USPC ..... 15/389, 390, 391, 392, 377, 383
See application file for complete search history.

(56) References Cited

U.S. PATENT DOCUMENTS 574,850 A * 1/1897 Carrier ..... A47L 5/34 15/384
715,408 A * 12/1902 Murray et al. ..... E04H 4/1654 15/384
2,102,645 A * 12/1937 Benson ..... A47L 9/0411 15/377
4,426,751 A 1/1984 Nordeen
4,654,927 A * 4/1987 Novinger ..... A47L 5/30 15/384
5,018,240 A * 5/1991 Holman ..... A47L 5/30 15/384
5,077,863 A 1/1992 Rench
(Continued)

FOREIGN PATENT DOCUMENTS

CH 499978 A 12/1970
CN 104352206 A 2/2015
(Continued)

OTHER PUBLICATIONS

CN-108968800-A espacenet (Year: 2024).*
(Continued)

*Primary Examiner* — Brian D Keller
*Assistant Examiner* — Tim Brady
(74) *Attorney, Agent, or Firm* — Posz Law Group, PLC

(57) ABSTRACT

A cleaner head includes a housing having a suction port facing a cleaning target surface, a first rotary brush provided in the housing, a second rotary brush provided in the housing, and a suction area provided between the first rotary brush and the second rotary brush and connecting to the suction port. The first rotary brush and the second rotary brush rotate in directions opposite to each other.

20 Claims, 11 Drawing Sheets

(56) References Cited

U.S. PATENT DOCUMENTS

| | | | | |
|---|---|---|---|---|
| 7,441,306 | B2 | 10/2008 | Kim | |
| 9,326,654 | B2 | 5/2016 | Doughty | |
| 9,351,617 | B2 * | 5/2016 | De Wit | A47L 11/40 |
| 2003/0188397 | A1 * | 10/2003 | Syverson | A47L 9/0411 15/389 |
| 2004/0055106 | A1 * | 3/2004 | Yacobi | A47L 5/30 15/384 |
| 2005/0071948 | A1 | 4/2005 | Moshenrose | |
| 2005/0160556 | A1 * | 7/2005 | Hitzelberger | A47L 9/0488 15/384 |
| 2005/0172447 | A1 * | 8/2005 | Roney | A47L 9/0494 15/384 |
| 2006/0288521 | A1 | 12/2006 | Ogawa et al. | |
| 2010/0115719 | A1 | 5/2010 | West et al. | |
| 2011/0303239 | A1 * | 12/2011 | Harrison | A47L 9/0438 15/389 |
| 2013/0086769 | A1 * | 4/2013 | Iles | A47L 9/0444 15/363 |
| 2016/0174792 | A1 * | 6/2016 | Williamson | A46B 13/00 15/383 |
| 2016/0198918 | A1 * | 7/2016 | Sun | A47L 9/0455 15/347 |
| 2016/0220080 | A1 | 8/2016 | Thorne | |
| 2016/0256025 | A1 | 9/2016 | Van Der Kooi et al. | |
| 2018/0192836 | A1 | 7/2018 | Dodgson | |
| 2019/0150686 | A1 | 5/2019 | Horne et al. | |
| 2020/0221914 | A1 | 7/2020 | Kim et al. | |
| 2020/0237088 | A1 * | 7/2020 | Jung | A46B 13/008 |

FOREIGN PATENT DOCUMENTS

| | | | | | |
|---|---|---|---|---|---|
| CN | 107854047 | A | | 3/2018 | |
| CN | 207186575 | U | | 4/2018 | |
| CN | 207855632 | U | | 9/2018 | |
| CN | 108882815 | A | | 11/2018 | |
| CN | 108903798 | A | | 11/2018 | |
| CN | 108968800 | A | * | 12/2018 | A47L 9/00 |
| CN | 108968800 | A | | 12/2018 | |
| CN | 208319146 | U | | 1/2019 | |
| CN | 208709743 | U | | 4/2019 | |
| EP | 3662804 | A1 | | 6/2020 | |
| GB | 2394407 | A | | 4/2004 | |
| JP | H05-111449 | A | | 5/1993 | |
| JP | H05-228083 | A | | 9/1993 | |
| JP | H08-289863 | A | | 11/1996 | |
| JP | H09-10143 | A | | 1/1997 | |
| JP | 2001-245831 | A | | 9/2001 | |
| JP | 2002-204767 | A | | 7/2002 | |
| JP | 2004141610 | A | | 5/2004 | |
| JP | 2007-000465 | A | | 1/2007 | |
| JP | 2007-061346 | A | | 3/2007 | |
| JP | 2008-104840 | A | | 5/2008 | |
| JP | 2015-154836 | A | | 8/2015 | |
| JP | 2017-221702 | A | | 12/2017 | |
| JP | 2018-000754 | A | | 1/2018 | |
| JP | 2018-110855 | A | | 7/2018 | |
| JP | 2018-521707 | A | | 8/2018 | |
| JP | 2019-025150 | A | | 2/2019 | |
| JP | 2019-514661 | A | | 6/2019 | |
| KR | 20180109261 | A | | 10/2018 | |
| KR | 10-2019-0021521 | A | | 3/2019 | |
| WO | 2008/099584 | A1 | | 8/2008 | |

OTHER PUBLICATIONS

Office Action issued Jun. 18, 2023 in connection with counterpart Chinese Patent Application No. 201980096795.1 (and English machine translation).

Office Action issued Feb. 9, 2023 in connection with counterpart Canadian Patent Application No. 3,141,300.

Office Action issued on Apr. 6, 2022 in connection with counterpart Indian Patent Application No. 202127054545.

International Search Report of the International Searching Authority mailed Aug. 27, 2019 for the corresponding International application No. PCT/JP2019/022742 (and English translation).

Reconsideration Report by Examiner before Appeal drafted Apr. 25, 2023 in connection with counterpart JP Patent Application No. 2021-524639 ( and English translation attached).

Extended European Search Report issued on May 17, 2022 in connection with counterpart European Patent Application No. 19931909.6.

Office Action issued Nov. 25, 2022 in connection with counterpart Australian Patent Application No. 2019449365.

Office Action dated Nov. 15, 2022 issued in corresponding CN Patent Application No. 201980096795.1 (and English translation).

Office Action issued on Jul. 5, 2022 in connection with counterpart Japanese Patent Application No. 2021-524639 (and English machine translation).

Office Action issued on Jun. 15, 2022 in connection with counterpart Chinese Patent Application No. 201980096795.1 (and English machine translation).

Office Action issued on Mar. 31, 2023 in connection with counterpart Australian Patent Application No. 2019449365.

Office Action issued Sep. 16, 2023 in connection with counterpart Chinese Patent Application No. 201980096795.1 (and English translation).

Decision of Refusal issued Nov. 8, 2022 in corresponding JP Patent Application No. 2021-524639 (with English machine translation).

Hearing Notice issued on Oct. 10, 2023 in connection with counterpart Indian Patent Application No. 202127054545 (and English translation).

Office Action issued on Dec. 5, 2023 in connection with counterpart Japanese Patent Application No. 2023-014687 (and English machine translation).

Office Action issued Apr. 2, 2024 in connection with counterpart Japanese Patent Application No. 2021-524639 (and English machine translation).

Office Action mailed May 7, 2024 in corresponding Japanese Patent Application No. 2023-014687 (and English machine translation).

* cited by examiner

CLEANER HEAD AND VACUUM CLEANER

CROSS REFERENCE TO RELATED APPLICATION

This application is a U.S. national stage application of International Patent Application No. PCT/JP2019/022742 filed on Jun. 7, 2019, the disclosure of which is incorporated herein by reference.

TECHNICAL FIELD

The present invention relates to a vacuum cleaner and a cleaner head of the vacuum cleaner.

BACKGROUND

A cleaner head of a vacuum cleaner includes a housing that is connected to a cleaner main body by a pipe, and a rotary brush that is provided in the housing and scrapes up dust on a floor surface (see Patent Reference 1, for example).

PATENT REFERENCE

Patent Reference 1: Japanese Patent Application Publication No. 2017-221702 (abstract)

However, part of the dust scrapes up by the rotary brush is not sucked into the housing but is scattered rearward. Such dust remains on the floor surface.

SUMMARY

The present invention is made to solve the above-described problem, and an object of the present invention is to provide a cleaner head and a vacuum cleaner capable of efficiently sucking in dust.

A cleaner head according to an aspect of the present invention includes a housing having a suction port facing a cleaning target surface, the housing having a top portion on a side opposite to the cleaning target surface, a first rotary brush provided in the housing, a second rotary brush provided in the housing, a suction area provided between the first rotary brush and the second rotary brush and connecting to the suction port, and a communicating portion provided on the top portion of the housing and connecting to a cleaner main body. The first rotary brush and the second rotary brush rotate in directions opposite to each other.

According to the present invention, dust which is not scraped up by the first rotary brush can be scraped up by the second rotary brush. Further, since the suction area is provided between the first rotary brush and the second rotary brush, the dust scraped up by the two rotary brushes can be guided to the suction area and sucked in. Accordingly, it becomes possible to efficiently suck in dust.

DETAILED DESCRIPTION

Embodiments of the present invention will be described in detail below with reference to the drawings. Incidentally, the present invention is not restricted by these embodiments.

First Embodiment (Overall Configuration of Vacuum Cleaner)

Figure 1:
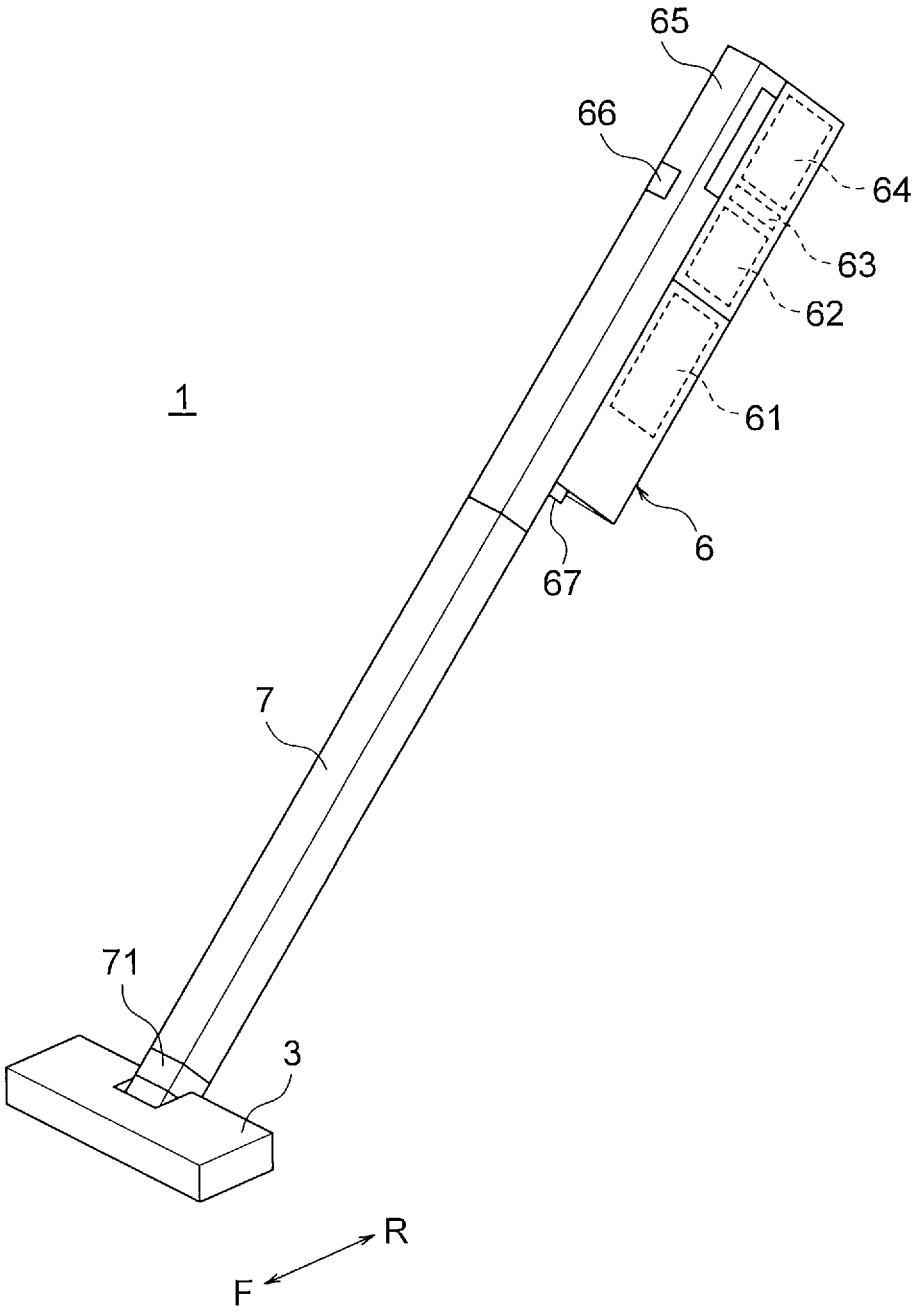
FIG. 1 is a diagram showing a vacuum cleaner in a first embodiment.

FIG. 1 is a diagram showing a vacuum cleaner 1 in a first embodiment. The vacuum cleaner 1 in this example is an upright vacuum cleaner of a cordless type. The vacuum cleaner 1 includes a cleaner main body 6, a cleaner head 3, and a pipe 7 connecting the cleaner main body 6 and the cleaner head 3.

The cleaner head 3 includes a suction port 32 (FIG. 2) which will be described later. The cleaner head 3 is a part for sucking in dust on a floor surface as a cleaning target surface.

One end of the pipe 7 is attached to the cleaner head 3 and the other end of the pipe 7 is attached to the cleaner main body 6. The pipe 7 includes a connecting portion 71 that is connected to the cleaner head 3, and the pipe 7 is configured so that its angle with respect to the cleaner head 3 is changeable. The pipe 7 forms a channel between the cleaner main body 6 and the cleaner head 3.

The cleaner main body 6 includes a dust collection container 61, an electric blower 62, a control circuit 63, a battery 64, a grip portion 65 and a switch 66.

The electric blower 62 includes a blower motor and an impeller wheel, and generates a suction airflow flowing from the cleaner head 3 to the dust collection container 61 through the pipe 7. The dust collection container 61 separates dust from air sucked in by the suction airflow of the electric blower 62, and stores the dust.

The control circuit 63 controls the blower motor of the electric blower 62 and a motor 40 (FIG. 2) in the cleaner head 3 which will be described later. The battery 64 supplies electric power to the blower motor of the electric blower 62, the motor 40 in the cleaner head 3 and the control circuit 63.

The grip portion 65 is a handle gripped by an operator. The switch 66 is an operation unit with which the operator turns on and off the vacuum cleaner 1. When the switch 66 is turned on, the electric blower 62 and rotary brushes 10 and 20 (FIG. 2) of the cleaner head 3 which will be described later start rotating.

(Configuration of Cleaner Head)

Figure 2:
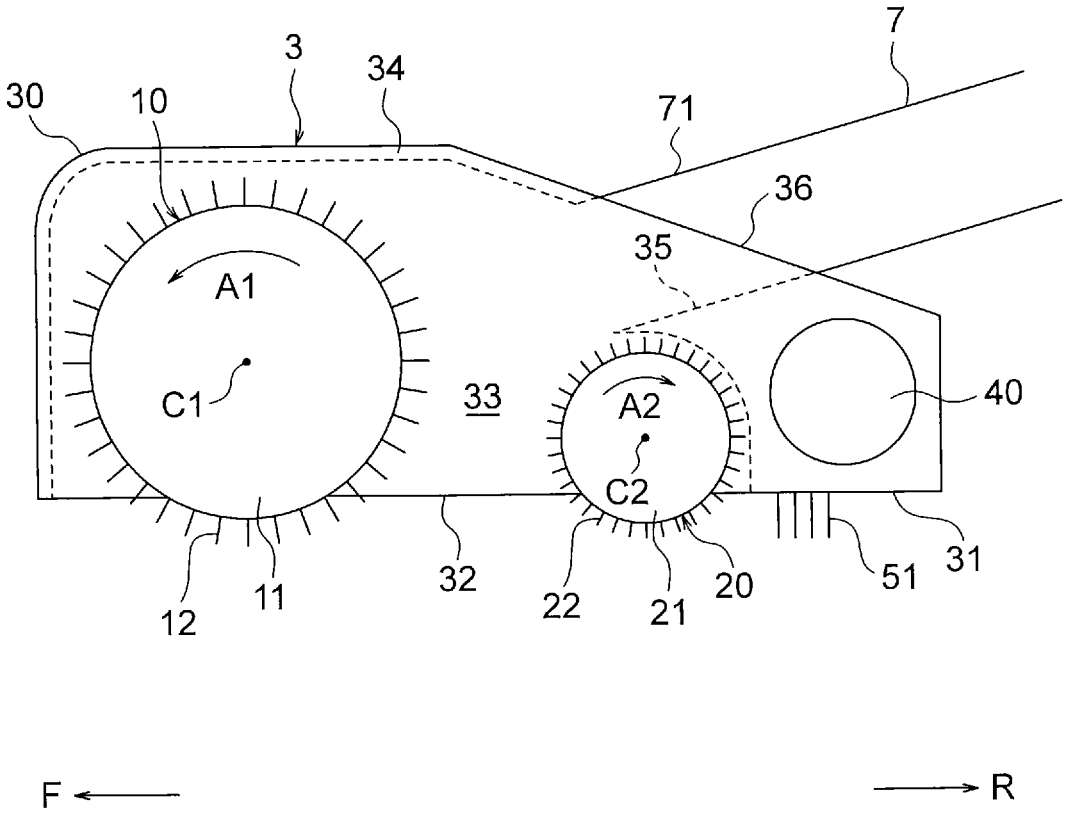
FIG. 2 is a diagram showing a cleaner head in the first embodiment.

Next, the configuration of the cleaner head 3 will be described. FIG. 2 is a diagram showing the configuration of the cleaner head 3. In FIG. 2, a traveling direction of the cleaner head 3 when the operator gripping the grip portion 65 (FIG. 1) of the vacuum cleaner 1 pushes the vacuum cleaner 1 forward is defined as a "forward direction" and is indicated by an arrow F. Further, a direction opposite to the forward direction is defined as a "rearward direction" and is indicated by an arrow R.

The cleaner head 3 has a housing 30 as a casing. The housing 30 includes a bottom portion 31 facing the floor surface as the cleaning target surface and a top portion 34 on a side opposite to the bottom portion 31. In a state in which the vacuum cleaner 1 is used, the bottom portion 31 is horizontal, that is, parallel to the floor surface. The suction port 32 as an opening is formed on the bottom portion 31 of the housing 30. A communicating portion 36 as an opening connecting to the pipe 7 is famed at the rear of the top portion 34 of the housing 30.

The cleaner head 3 includes a first rotary brush 10 and a second rotary brush 20 in the housing 30. The first rotary brush 10 is disposed forward and the second rotary brush 20 is disposed rearward. The first rotary brush 10 and the second rotary brush 20 project from the suction port 32 to the outside of the housing 30.

The first rotary brush 10 and the second rotary brush 20 respectively rotate about rotation axes C1 and C2 parallel to each other. Both of the rotation axis C1 of the first rotary brush 10 and the rotation axis C2 of the second rotary brush 20 are parallel to a widthwise direction of the cleaner head 3, that is, a left-right direction.

The first rotary brush 10 rotates counterclockwise as indicated by an arrow A1 in FIG. 2. Namely, the first rotary brush 10 rotates so that its outer circumferential surface projecting from the suction port 32, that is, the outer circumferential surface facing the floor surface as the cleaning target surface, moves in the rearward direction.

The second rotary brush 20 rotates clockwise as indicated by an arrow A2 in FIG. 2. Namely, the second rotary brush 20 rotates so that its outer circumferential surface projecting from the suction port 32, that is, the outer circumferential surface facing the floor surface as the cleaning target surface, moves in the forward direction.

In other words, the first rotary brush 10 and the second rotary brush 20 rotate in directions opposite to each other. More specifically, the first rotary brush 10 and the second rotary brush 20 rotate in directions so that their outer circumferential surfaces facing the floor surface as the cleaning target surface approach each other.

In the housing 30, a suction area 33 is formed between the first rotary brush 10 and the second rotary brush 20. The suction area 33 connects to the suction port 32 and functions as an area in which the dust scraped up from the floor surface by the first rotary brush 10 and the second rotary brush 20 is accommodated.

In the housing 30, a partition plate 35 as a partition member is provided between the suction area 33 and the second rotary brush 20. The partition plate 35 extends from the bottom portion 31 along a rotating direction of the second rotary brush 20. The above-described communicating portion 36 is disposed adjacent to the partition plate 35.

The partition plate 35 is famed to contact a brush portion 22 of the second rotary brush 20 which will be described later. The partition plate 35 has a function of raking out dust that is fine or heavy in specific weight and is likely to be buried in the brush portion 22 of the second rotary brush 20, from the brush portion 22.

In addition to the bottom portion 31 and the top portion 34, the housing 30 has walls on its front side, rear side, left side and right side. Thus, the housing 30 has a structure that is hermetic except for the suction port 32 and the communicating portion 36.

Figure 3:
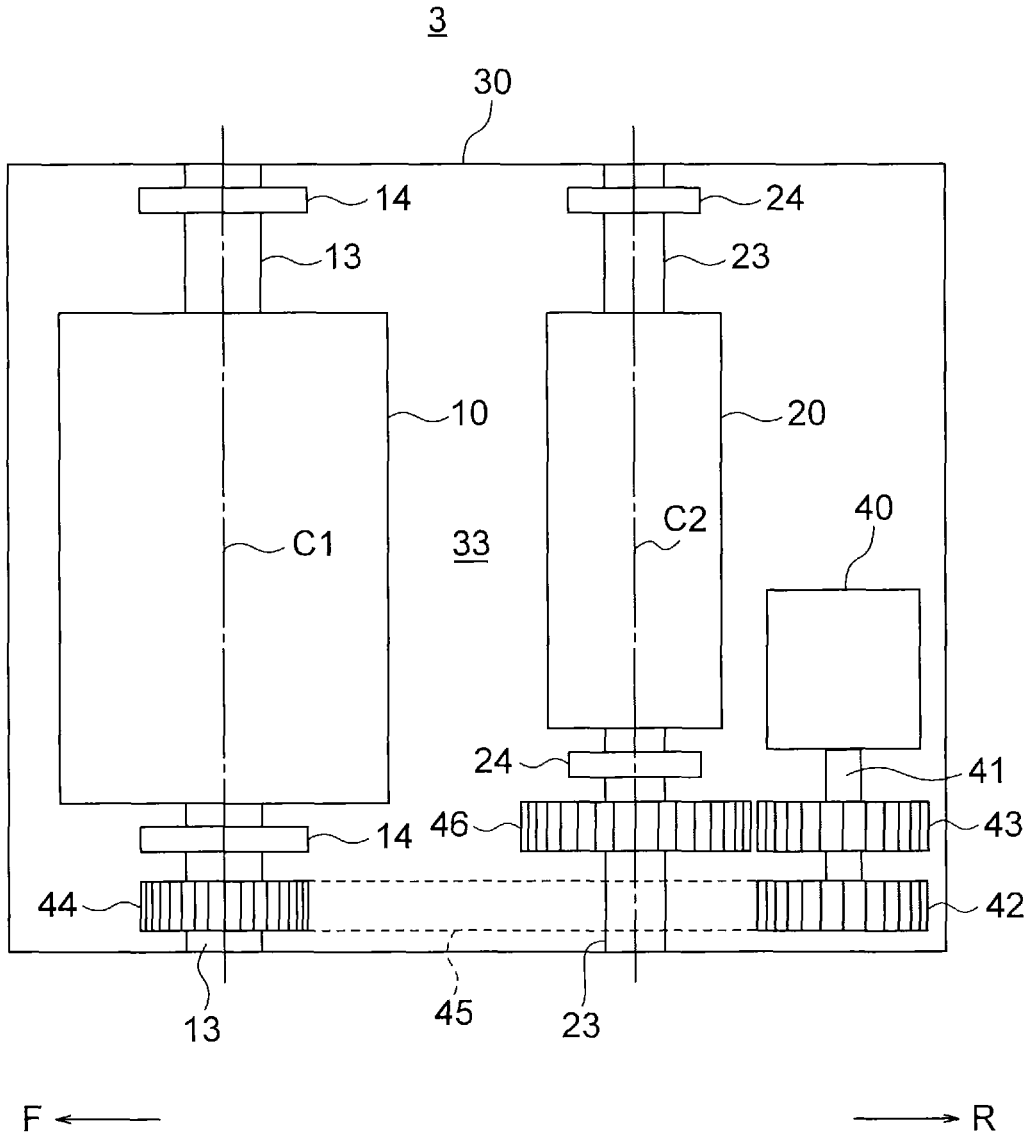
FIG. 3 is a diagram showing a two-dimensional arrangement of components of the cleaner head in the first embodiment.

FIG. 3 is a diagram showing a two-dimensional arrangement of components in the cleaner head 3. The first rotary brush 10 includes a shaft 13, and the shaft 13 is rotatably supported by a pair of bearing portions 14 provided in the housing 30. Similarly, the second rotary brush 20 includes a shaft 23, and the shaft 23 is rotatably supported by a pair of bearing portions 24 provided in the housing 30.

The motor 40 for driving the first rotary brush 10 and the second rotary brush 20 is provided in the housing 30. In this example, the motor 40 is disposed at the rear of the second rotary brush 20.

A gear 43 and a pulley 42 are attached to an output shaft 41 of the motor 40. A timing belt 45 is stretched over the pulley 42 and a pulley 44 attached to the shaft 13 of the first rotary brush 10. The rotation of the motor 40 is transmitted to the first rotary brush 10 via the pulley 42, the timing belt 45 and the pulley 44.

The gear 43 attached to the output shaft 41 of the motor 40 meshes with a gear 46 attached to the shaft 23 of the second rotary brush 20. The rotation of the motor 40 is transmitted to the second rotary brush 20 via the gears 43 and 46.

Figure 4:
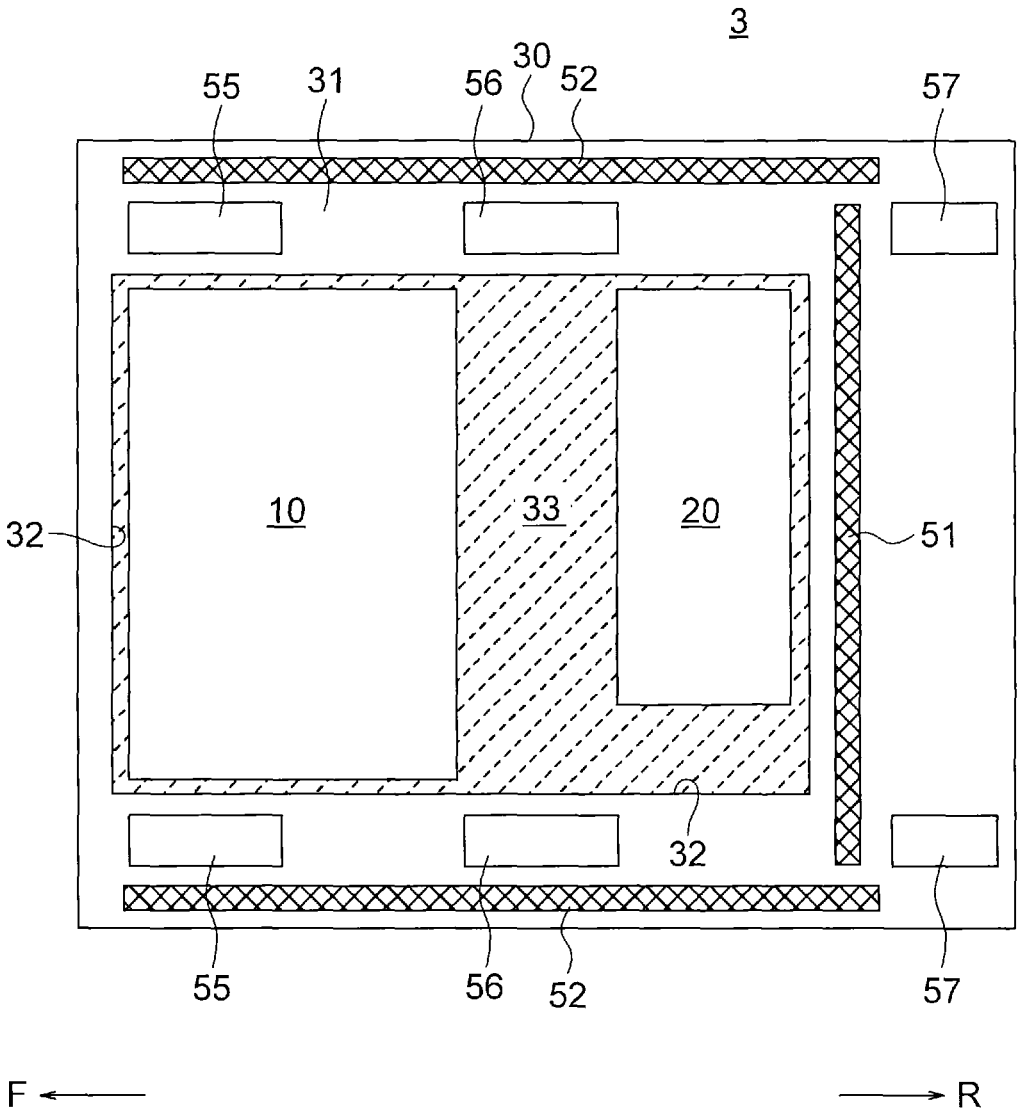
FIG. 4 is a bottom view showing the cleaner head in the first embodiment.

FIG. 4 is a bottom view showing the cleaner head 3. As described above, the suction port 32 is formed on the housing 30 of the cleaner head 3, and the first rotary brush 10 and the second rotary brush 20 project downward from the suction port 32. The suction port 32 in this example is a rectangular opening. In FIG. 4, the inside of the suction port 32 is indicated by hatching with broken lines.

In the bottom portion 31, a fabric body 51 is disposed at the rear of the suction port 32. The fabric body 51 extends in the widthwise direction of the cleaner head 3, that is, in the left-right direction. Further, in the bottom portion 31, fabric bodies 52 are disposed on the left and right sides of the suction port 32. The fabric bodies 52 extend in a front-rear direction.

The fabric bodies 51 and 52 are disposed to surround three sides of the suction port 32 except for a front side. Each of the fabric bodies 51 and 52 is famed of felt, for example. The felt is a material obtained by compressing fibers such as chemical fibers into a sheet-like shape, and is referred to also as nonwoven fabric. Incidentally, the fabric bodies 51 and 52 may also be brushes.

The fabric bodies 51 and 52 contact the floor surface to achieve a function of increasing hermeticity of a space formed by the housing 30 and the floor surface.

The cleaner head 3 includes contact rollers 55, 56 and 57 as contact portions. The contact rollers 55 are disposed at a front part of the housing 30. The contact rollers 56 are disposed at a center part of the housing 30 in the front-rear direction. The contact rollers 57 are disposed at a rear part of the housing 30. The contact rollers 55, 56 and 57 are disposed on each of the left and right sides of the housing 30.

Figure 5:
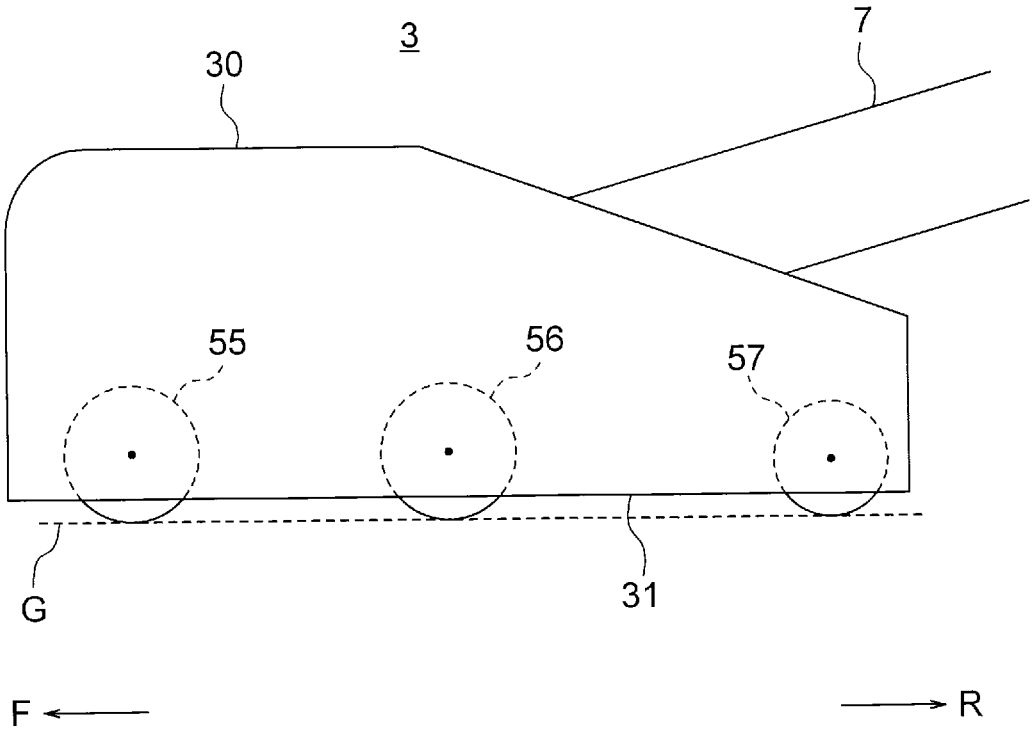
FIG. 5 is a diagram showing a housing and contact rollers of the cleaner head in the first embodiment.

FIG. 5 is a diagram showing the housing 30 and the contact rollers 55, 56 and 57. Each of the contact rollers 55, 56 and 57 is rotatably provided in the housing 30, projects from the bottom portion 31, and contacts the floor surface. Lowermost portions of the contact rollers 55, 56 and 57 define a reference surface G as a plane corresponding to the floor surface.

Incidentally, the positions and the number of the contact rollers can be changed appropriately. In place of the contact rollers, it is also possible to provide sliding surfaces that slide on the floor surface.

Figure 6A:
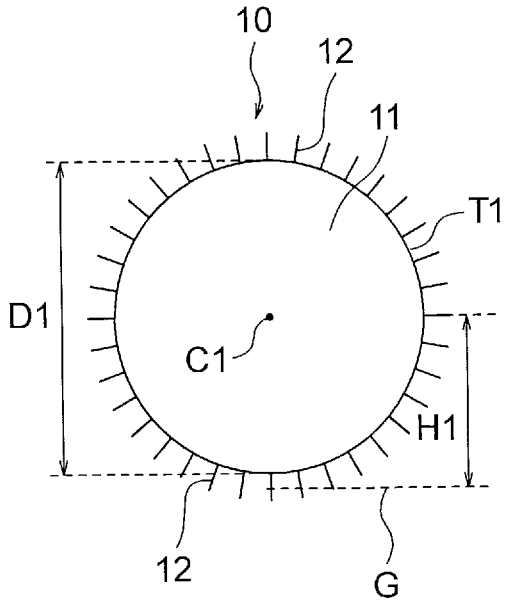
FIG. 6(A) is a diagram showing a first rotary brush in the first embodiment.

FIG. 6(A) is a side view showing the first rotary brush 10. The first rotary brush 10 includes a core portion 11 centering on the rotation axis C1 and a brush portion 12 attached to an outer circumference of the core portion 11. The core portion 11 includes the above-described shaft 13 (FIG. 3) at both ends in the direction of the rotation axis C1, and the shaft 13 is rotatably supported by the bearing portions 14 (FIG. 3).

Figure 7A:
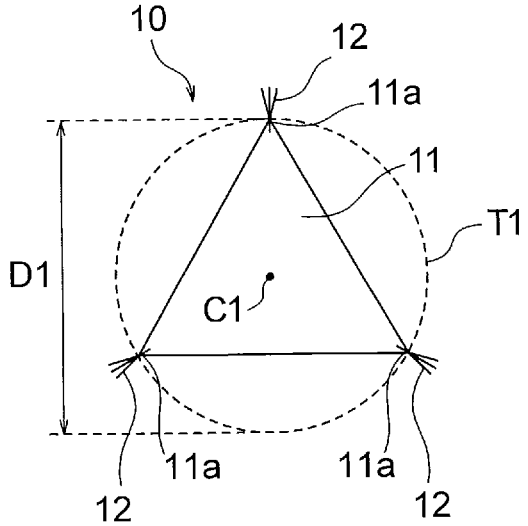
FIG. 7(A) is a diagram showing a configuration example of the first rotary brush in the first embodiment.

A cross-sectional shape of the core portion 11 in a plane perpendicular to the rotation axis C1 is a regular triangle shown in FIG. 7(A), for example. The core portion 11 has a shape such that the cross section shown in FIG. 7(A) is displaced in a circumferential direction as a position of the cross section is moved in the direction of the rotation axis C1. In other words, the core portion 11 has a shape obtained by twisting a triangular prism about the rotation axis C1.

When the first rotary brush 10 rotates, outermost ends 11*a* (FIG. 7(A)) of the core portion 11 farthest from the rotation axis C1 move to draw a circle T1. The circle T1 as a trajectory of the outermost ends 11*a* of the core portion 11 has a diameter D1. In a state in which the cleaner head 3 is placed on the floor surface, a height from the floor surface, i.e., the reference surface G, to the rotation axis C1 is expressed as H1.

Incidentally, the shape of the core portion 11 is not limited to the shape shown in FIG. 7(A), but may be a shape shown in FIG. 8 which will be explained later.

The brush portion 12 is formed of, for example, chemical fibers such as nylon (polyamide synthetic resin), polypropylene or polyester, or carbon fibers. Hardness of the fibers is adjusted by adjusting the thickness of each fiber in the brush portion 12.

Figure 6B:
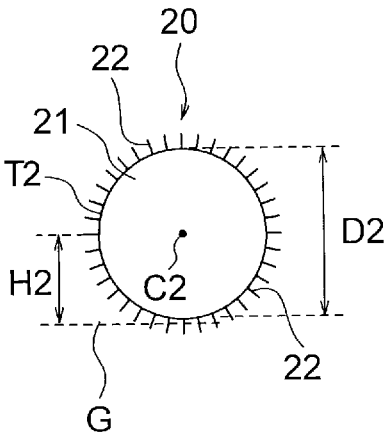
FIG. 6(B) is a diagram showing a second rotary brush in the first embodiment.

FIG. 6(B) is a side view showing the second rotary brush 20. The second rotary brush 20 includes a core portion 21 centering on the rotation axis C2 and the brush portion 22 attached to an outer circumference of the core portion 21. The core portion 21 includes the above-described shaft 23 (FIG. 3) at both ends in the direction of the rotation axis C2, and the shaft 23 is rotatably supported by the bearing portions 24 (FIG. 3).

Figure 7B:
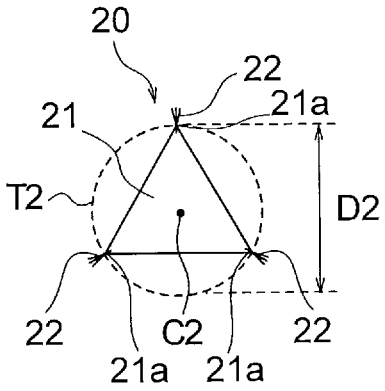
FIG. 7(B) is a diagram showing a configuration example of the second rotary brush in the first embodiment.

A cross-sectional shape of the core portion 21 in a plane perpendicular to the rotation axis C2 is a regular triangle shown in FIG. 7(B), for example. The core portion 21 has a shape such that the cross section shown in FIG. 7(B) is displaced in the circumferential direction as a position of the cross section is moved in the direction of the rotation axis C2. In other words, the core portion 21 has a shape obtained by twisting a triangular prism about the rotation axis C2.

When the second rotary brush 20 rotates, outermost ends 21*a* (FIG. 7(B)) of the core portion 21 farthest from the rotation axis C2 move to draw a circle T2. The circle T2 as a trajectory of the outermost ends 21*a* of the core portion 21 has a diameter D2. In a state in which the cleaner head 3 is placed on the floor surface, a height from the floor surface, i.e., the reference surface G, to the rotation axis C2 is expressed as H2.

Incidentally, the shape of the core portion 21 is not limited to the shape shown in FIG. 7(B), but may be the shape shown in FIG. 8 which will be explained later.

The brush portion 22 is formed of, for example, chemical fibers such as nylon (polyamide synthetic resin), polypropylene or polyester, or carbon fibers. Hardness of the fibers is adjusted by adjusting the thickness of each fiber in the brush portion 22.

As shown in FIGS. 6(A) and 6(B), the diameter D1 of the circle T1 as the trajectory of the outermost ends 11*a* of the core portion 11 is larger than the diameter D2 of the circle T2 as the trajectory of the outermost ends 21*a* of the core portion 21. Namely, D1>D2 is satisfied.

When the operator moves the cleaner head 3 forward, the first rotary brush 10 rotates to push the floor surface rearward, and thus assists the movement of the cleaner head 3. In contrast, the second rotary brush 20 rotates to push the floor surface forward, and thus works as resistance against the movement of the cleaner head 3. Since the above-described relationship D1>D2 is satisfied, a force with which the first rotary brush 10 pushes the floor surface is greater than a force with which the second rotary brush 20 pushes the floor surface, and thus the load on the operator is reduced.

Further, in a state in which the cleaner head 3 is placed on the floor surface, the distance H1 from the floor surface to the rotation axis C1 of the first rotary brush 10 is longer than the distance H2 from the floor surface to the rotation axis C2 of the second rotary brush 20. Namely, H1>H2 is satisfied.

In other words, the second rotary brush 20 is closer to the floor surface as compared with the first rotary brush 10. Therefore, the degree of adhesion between the second rotary brush 20 and the floor surface is high, and thus the dust which is not scraped up by the first rotary brush 10 is efficiently scraped up by the second rotary brush 20.

Figure 8:
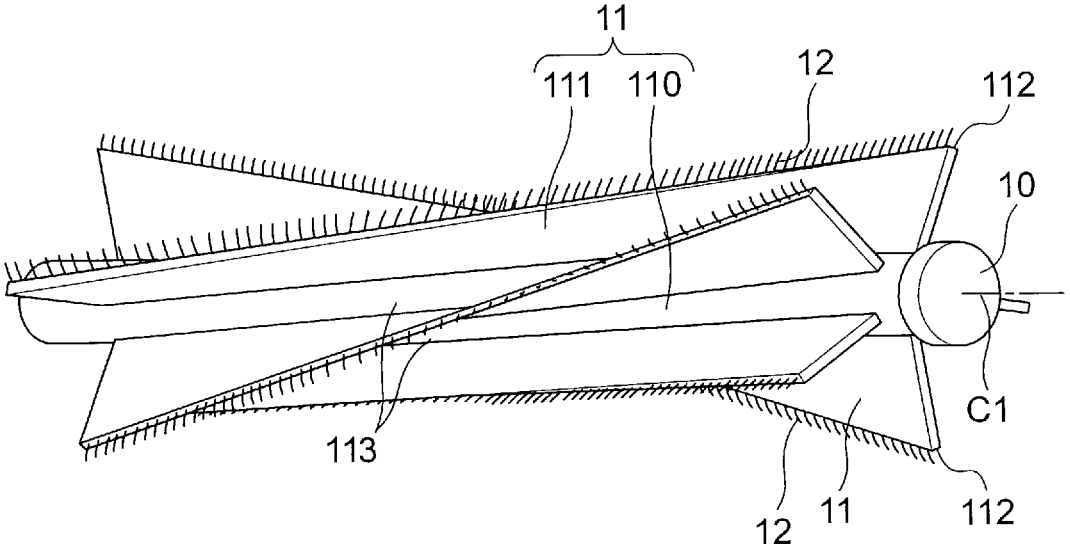
FIG. 8 is a perspective view showing another configuration example of the first rotary brush in the first embodiment.

FIG. 8 is a perspective view showing another configuration example of the first rotary brush 10. The first rotary brush 10 shown in FIG. 8 includes a core portion 11 and a brush portion 12. The core portion 11 includes a cylindrical center shaft 110 and blades 111 spirally famed around the center shaft 110. A plurality of blades 111, for example, five blades 111, are famed centering on the rotation axis C1. A groove portion 113 is formed between the blades 111 adjacent to each other in the circumferential direction.

Each blade 111 has a tip end, namely, an outermost end 112, on a side opposite to the rotation axis C1. A trajectory drawn by the outermost ends 112 of the blade 111 when the first rotary brush 10 rotates is the circle T1 explained with reference to FIG. 6(A). The brush portion 12 is formed on the outermost end 112 of each blade 111.

In a case where each blade 111 extends in parallel with the rotation axis C1, the height of the first rotary brush 10 from the floor surface differs between when the brush portion 12 contacts the floor surface and when the groove portion 113 faces the floor surface. This may cause vibration.

In contrast, in the case where the brush portion 12 is formed at the outermost end 112 of each of the spiral blades 111, the brush portion 12 partially contacts the floor surface constantly during the rotation of the first rotary brush 10. Thus, the vibration of the first rotary brush 10 is inhibited. Incidentally, the shape shown in FIG. 8 is applicable also to the second rotary brush 20.

Figure 9:
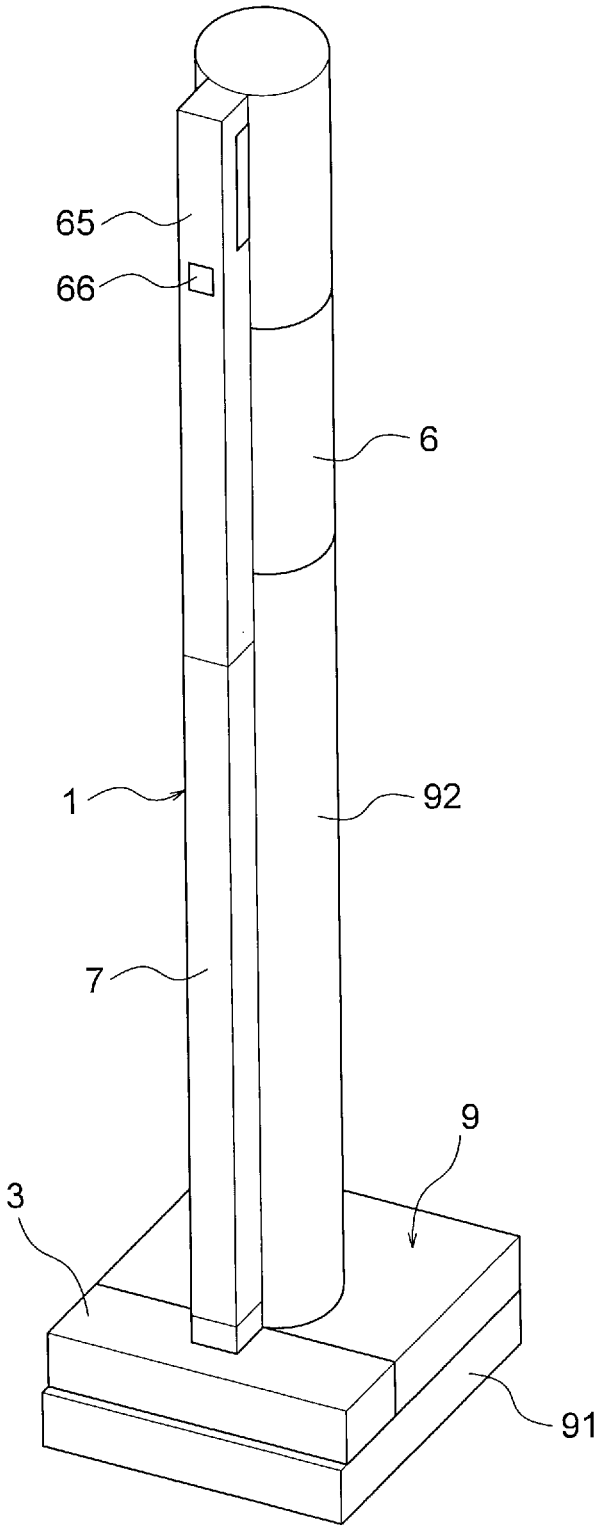
FIG. 9 is a perspective view showing a state in which the cleaner head in the first embodiment is mounted to a charging stand.

FIG. 9 is a diagram showing a state in which the vacuum cleaner 1 is mounted to a charging stand 9. The charging stand 9 includes a pedestal portion 91 and a support portion 92. The pedestal portion 91 is a part on which the cleaner head 3 of the vacuum cleaner 1 is placed. The support portion 92 extends upward from the pedestal portion 91. On the top of the support portion 92, the cleaner main body 6 of the vacuum cleaner 1 is placed.

The cleaner main body 6 of the vacuum cleaner 1 has an electric power receiver 67 (FIG. 1) connected to the battery 64. The support portion 92 of the charging stand 9 has an electric power feeder which is to be connected to the electric power receiver 67 of the cleaner main body 6. The charging stand 9 is connected to a commercial power supply. When the vacuum cleaner 1 is mounted to the charging stand 9, the electric power receiver 67 is connected to the electric power feeder, and the battery 64 is charged.

(Operation of Vacuum Cleaner)

Next, the basic operation of the vacuum cleaner 1 in the first embodiment will be described with reference to FIGS. 1 to 3. When the operator grips the grip portion 65 of the vacuum cleaner 1 and presses the switch 66, the control circuit 63 drives the electric blower 62. The electric blower 62 generates the suction airflow flowing from the cleaner head 3 to the dust collection container 61 through the pipe 7.

The control circuit 63 also drives the motor 40 of the cleaner head 3. The rotation of the motor 40 is transmitted to the first rotary brush 10 via the pulley 42, the timing belt 45 and the pulley 44, so that the first rotary brush 10 rotates. Further, the rotation of the motor 40 is transmitted to the second rotary brush 20 via the gear 43 and the gear 46, so that the second rotary brush 20 rotates.

Due to the suction airflow generated by the electric blower 62, air containing dust is sucked in through the suction port 32 of the cleaner head 3. The air sucked in through the cleaner head 3 reaches the cleaner main body 6 through the pipe 7. In the cleaner main body 6, the dust collection container 61 separates the dust from the air and stores the dust.

Figure 10:
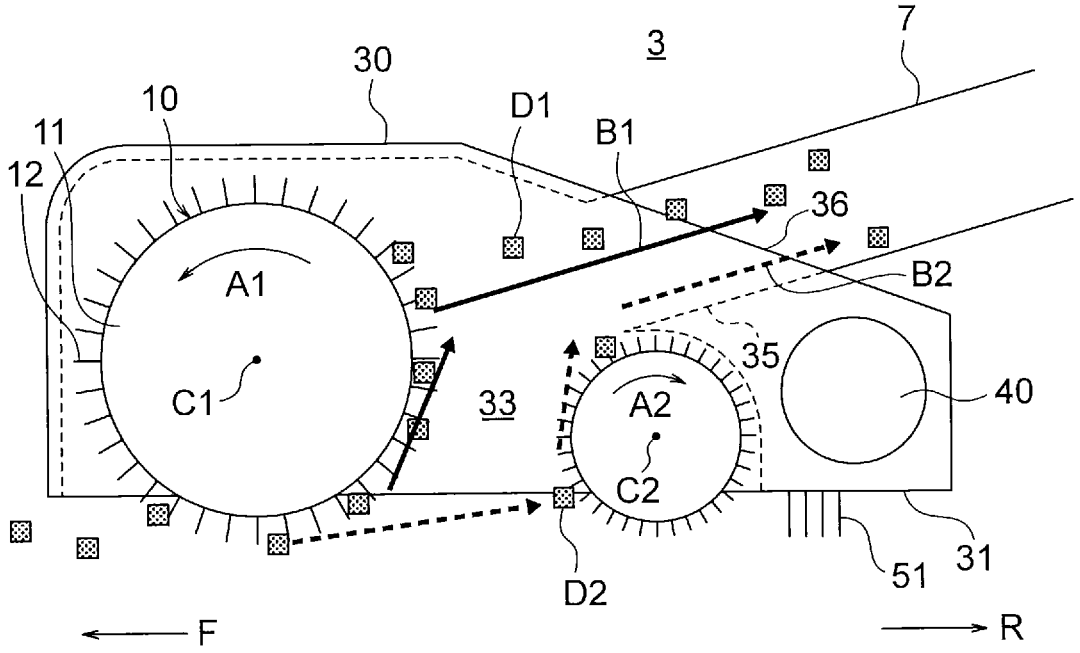
FIG. 10 is a schematic diagram showing a state in which dust is sucked in by the cleaner head in the first embodiment.

Next, the suction of dust in the cleaner head 3 will be described further. FIG. 10 is a schematic diagram showing a state in which dust is sucked in by the cleaner head 3. The first rotary brush 10 rotates as indicated by the arrow A1 so that the outer circumferential surface of the first rotary brush 10 contacting the floor surface moves in the rearward direction. Accordingly, when the operator moves the vacuum cleaner 1 forward, the first rotary brush 10 pushes the floor surface rearward and thereby assists the forward movement of the vacuum cleaner 1.

Due to the rotation of the first rotary brush 10, dust D1 on the floor surface is scraped up by the brush portion 12 of the first rotary brush 10. The dust D1 scraped up by the brush portion 12 is carried upward in the suction area 33 due to the rotation of the first rotary brush 10, and is sucked into the pipe 7 through the communicating portion 36 as indicated by an arrow B1 due to the above-described suction air flow.

On the other hand, part D2 of the dust on the floor surface is scattered rearward by the first rotary brush 10. Such dust D2 scattered rearward by the first rotary brush 10 is captured by the brush portion 22 of the second rotary brush 20.

The dust D2 captured by the brush portion 22 of the second rotary brush 20 is carried upward in the suction area 33 due to the rotation of the second rotary brush 20, and is sucked into the pipe 7 through the communicating portion 36 as indicated by an arrow B2 due to the suction air flow.

Figure 11:
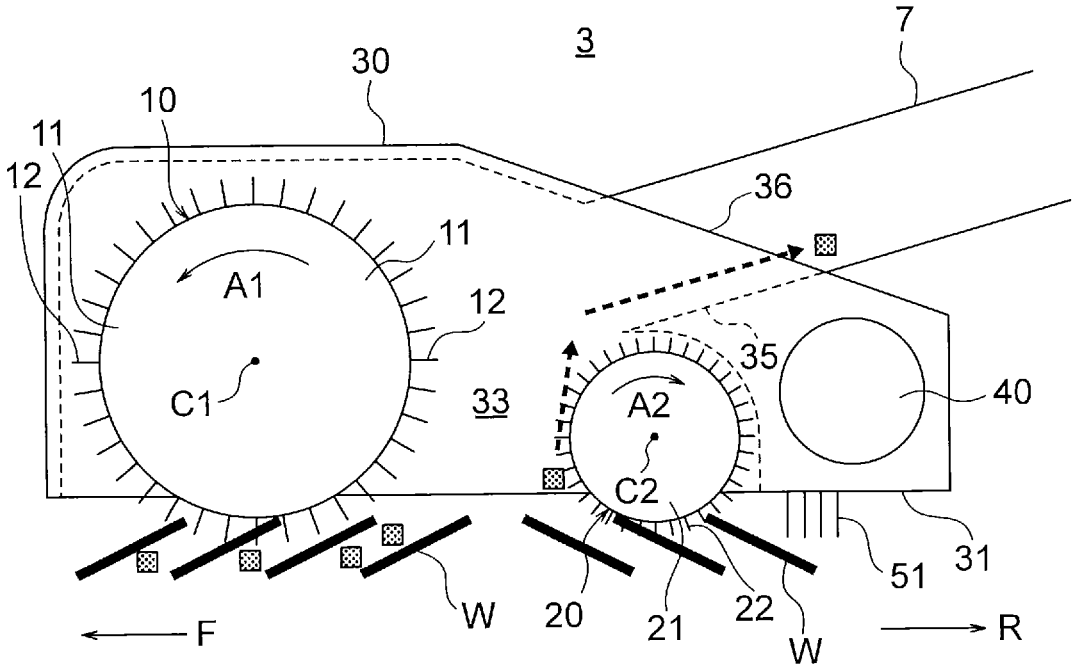
FIG. 11 is a schematic diagram showing a state in which dust is sucked in by the cleaner head in the first embodiment.

FIG. 11 is a schematic diagram showing a state in which dust on a carpet is sucked in by the cleaner head 3. In a cleaner head in which the first rotary brush 10 and the second rotary brush 20 rotate in the same direction, carpet hairs W fall down in the rotating direction of the rotary brushes 10 and 20. This make it difficult to suck in dust between hairs.

In contrast, in this first embodiment, the first rotary brush 10 and the second rotary brush 20 rotate in opposite directions. Thus, the carpet hairs W made to fall down by the first rotary brush 10 can be raised up or pushed down to the opposite side by the second rotary brush 20. Thus, the dust between the carpet hairs W can be scraped up by the second rotary brush 20.

When the vacuum cleaner 1 is used, the cleaner head 3 is moved not only forward but also rearward. Since the first rotary brush 10 rotates so as to push the floor surface rearward, the rotation of the first rotary brush 10 assists the forward movement of the cleaner head 3, and works as resistance against the rearward movement of the cleaner head 3. Meanwhile, since the second rotary brush 20 rotates so as to push the floor surface forward, the rotation of the second rotary brush 20 assists the rearward movement of the cleaner head 3, and works as resistance against the forward movement of the cleaner head 3.

In general, when the vacuum cleaner 1 is used, the frequency of moving the cleaner head 3 forward is higher than the frequency of moving the cleaner head 3 rearward. In the first embodiment, the diameter D1 of the core portion 11 of the first rotary brush 10 is larger than the diameter D2 of the core portion 21 of the second rotary brush 20 (D1>D2), and thus the forward movement of the cleaner head 3 is assisted securely.

Further, since the pipe 7 is connected to a rear part of the housing 30 of the cleaner head 3, the cleaner head 3 can be configured to be more compact when the diameter D2 of the core portion 21 of the second rotary brush 20 is smaller than the diameter D1 of the core portion 11 of the first rotary brush 10.

Furthermore, it is necessary that the second rotary brush 20 scrapes up dust that is not scraped up by the first rotary brush 10. Therefore, in this first embodiment, the distance H2 from the floor surface to the rotation axis C2 of the second rotary brush 20 is set shorter than the distance H1 from the floor surface to the rotation axis C1 of the first rotary brush 10.

With this setting, the second rotary brush 20 can be placed closer to the floor surface and the hermeticity of a space between the rear part of the housing 30 and the floor surface can be made high, and thus the dust can be scraped up more efficiently. Incidentally, the position of the floor surface with respect to the cleaner head 3 is represented by the reference surface G (FIG. 5) defined by the above-described contact rollers 55, 56 and 57.

On the other hand, when the second rotary brush 20 is placed closer to the floor surface, there is a possibility that the second rotary brush 20 vibrates vertically due to contact with dust on the floor surface. In this first embodiment, the fabric body 51 formed of felt or the like is provided at the rear of the second rotary brush 20, and thus the hermeticity of the space between the rear part of the housing 30 and the floor surface can be maintained to be high even when the second rotary brush 20 vibrates. Thus, the dust can be scraped up more efficiently by the second rotary brush 20.

Although large dust on the floor surface is easily scraped up by the first rotary brush 10, dust that is fine or heavy in specific weight is not easily scraped up by the first rotary brush 10. Such dust which is not scraped up by the first rotary brush 10 is scraped up by the second rotary brush 20.

However, the dust that is fine or heavy in specific weight is likely to be buried in the brush portion 22 of the second rotary brush 20. Therefore, the dust buried in the brush portion of the second rotary brush 20 is scraped from the brush portion 22 by the partition plate 35.

Figure 12:
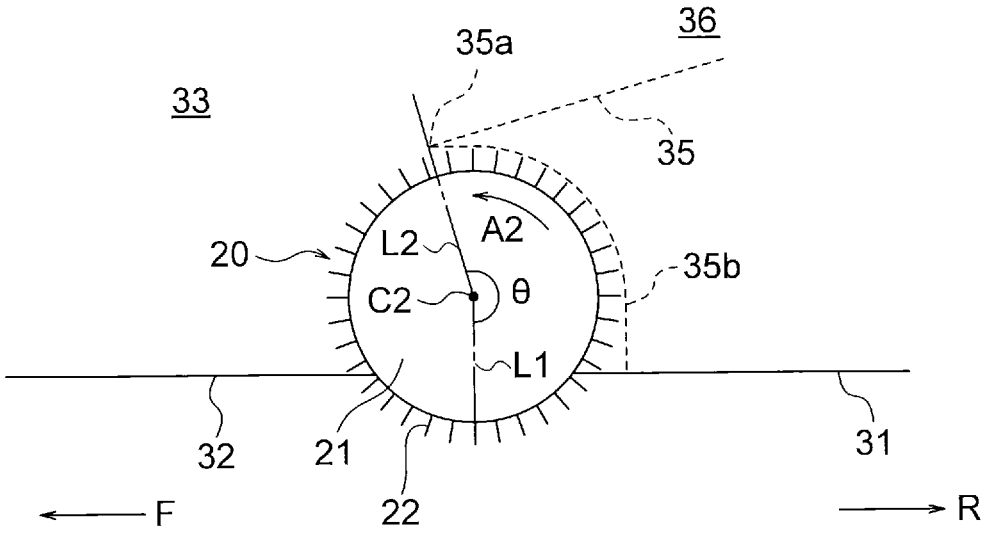
FIG. 12 is a diagram showing a partition plate of the cleaner head in the first embodiment.

FIG. 12 is a diagram showing the second rotary brush 20 and the partition plate 35. The partition plate 35 has a contact surface 35*b* that makes contact with the tip ends of the brush portion 22. When the second rotary brush 20 rotates, the brush portion 22 contacts and slides on the contact surface 35*b* while bending. When the brush portion 22 passes by a tip end 35*a* of the partition plate 35, the brush portion 22 returns to the state before bending. At that time, the dust buried in the brush portion 22 is sprung out. The dust sprung out of the brush portion 22 is sucked into the pipe 7 through the communicating portion 36.

Here, a line connecting the rotation axis C2 of the second rotary brush 20 and a lowermost point of the second rotary brush 20 is defined as a straight line L1. Further, a line connecting the rotation axis C2 of the second rotary brush 20 and the tip end 35*a* of the partition plate 35 in the rotating direction of the second rotary brush 20 is defined as a straight line L2. An angle θ formed by the straight line L1 and the straight line L2 is desirably larger than or equal to 90 degrees.

Figure 13:
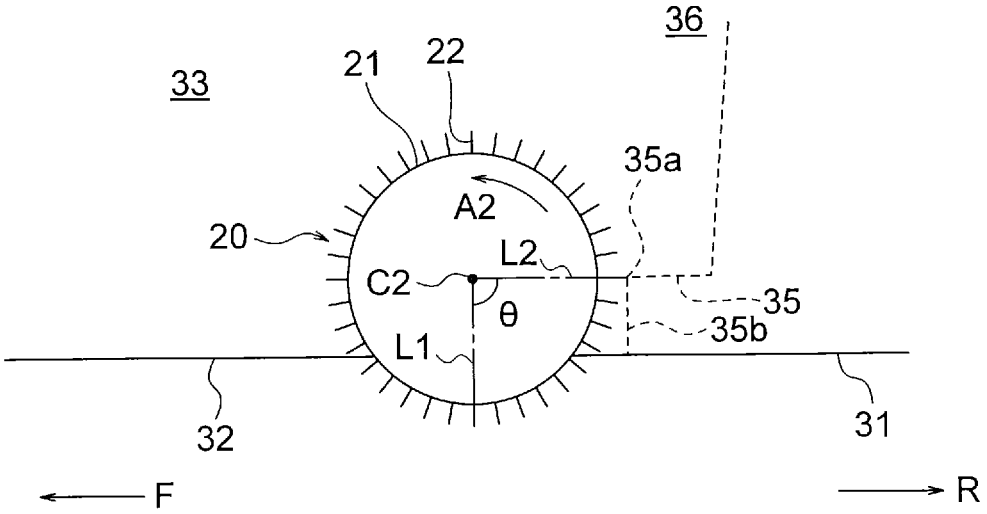
FIG. 13 is a diagram showing the partition plate of the cleaner head in the first embodiment.

FIG. 13 is a diagram showing another configuration example of the partition plate 35. In the example shown in FIG. 13, the angle θ formed by the straight line L1 and the straight line L2 is 90 degrees. In this case, fibers of the brush portion 22 extend in the horizontal direction when the fibers pass by the tip end 35*a* of the partition plate 35. Therefore, the dust is held on the fibers of the brush portion 22 and is sucked into the pipe 7 through the communicating portion 36.

In contrast, if the angle θ formed by the straight line L1 and the straight line L2 is less than 90 degrees, the fibers of the brush portion 22 are tilted downward when the fibers pass by the tip end 35*a* of the partition plate 35, and thus the dust may slip from the fibers down to the floor surface. Therefore, the angle θ formed by the straight line L1 and the straight line L2 is desirably larger than or equal to 90 degrees.

Further, an arrangement density of fibers in the brush portion 22 of the second rotary brush 20 is desirably higher than an arrangement density of fibers in the brush portion 12 of the first rotary brush 10. The arrangement density of fibers in the brush portion is a cross-sectional area of fibers per unit surface area of the core portion. The cross-sectional area of fibers means the product of the number of fibers and a cross-sectional area of each fiber.

By arranging the fibers of the brush portion 22 of the second rotary brush 20 at high density, the dust which is not scraped up by the first rotary brush 10 can be efficiently scraped up by the second rotary brush 20.

Incidentally, the brush portion 12 of the first rotary brush 10 is formed by fixing a sheet having brush hairs planted thereon to the core portion 11, for example. Similarly, the brush portion 22 of the second rotary brush 20 is famed by fixing a sheet having brush hairs planted thereon to the core portion 21, for example.

Each of the brush portion 12 of the first rotary brush 10 and the brush portion 22 of the second rotary brush 20 may be formed by combining a plurality of types of fibers. For example, it is possible to combine hard fibers and soft fibers or combine hard fibers, soft fibers and fibers having intermediate hardness.

Effect of Embodiment

As described above, according to the first embodiment, the first rotary brush 10 and the second rotary brush 20 are provided in the housing 30 having the suction port 32, and the suction area 33 connecting to the suction port 32 is provided between the first rotary brush 10 and the second rotary brush 20. Further, the first rotary brush 10 and the second rotary brush 20 rotate in directions opposite to each other. Accordingly, the dust which is not scraped up by the first rotary brush 10 can be efficiently scraped up by the second rotary brush 20 and sucked into the pipe 7 via the suction area 33.

Further, the first rotary brush 10 is disposed forward and the second rotary brush 20 is disposed rearward in the traveling direction of the cleaner head 3, the first rotary brush 10 rotates in the direction in which its outer circumferential surface facing the floor surface moves rearward, and the second rotary brush 20 rotates in the direction in which its outer circumferential surface facing the floor surface moves forward. Therefore, the rotation of the first rotary brush 10 assists the movement of the cleaner head 3 when the cleaner head 3 is moved forward, and the rotation of the second rotary brush 20 assists the movement of the cleaner head 3 when the cleaner head 3 is moved rearward. Accordingly, the load on the operator can be reduced.

Further, the first rotary brush 10 includes the core portion 11 as a first shaft portion and the brush portion 12 as a first brush portion, and the second rotary brush 20 includes the core portion 21 as a second shaft portion and the brush portion 22 as a second brush portion. Therefore, the dust on the floor surface can be efficiently scraped up by the fibers of the brush portions 12 and 22.

Further, the diameter D1 of the maximum circle T1 drawn by the core portion 11 when the core portion 11 rotates and the diameter D2 of the maximum circle T2 drawn by the core portion 21 when the core portion 21 rotates satisfy D1>D2. Thus, the assisting force applied when the cleaner head 3 is moved forward can be increased, and the load on the operator can be reduced further.

Further, the distance H1 from the reference surface G corresponding to the floor surface to the rotation axis C1 of the first rotary brush 10 is longer than the distance H2 from the reference surface G to the rotation axis C2 of the second rotary brush 20 (H1>H2). Thus, the second rotary brush 20 can be placed closer to the floor surface, and therefore the dust which is not scraped up by the first rotary brush 10 can be efficiently scraped up by the second rotary brush 20.

Further, the first rotary brush 10 and the second rotary brush 20 project from the suction port 32 to the outside of the housing 30. Thus, the dust scraped up from the floor surface by the first rotary brush 10 and the second rotary brush 20 can be moved through the suction port 32 to the suction area 33 and sucked into the pipe 7.

Further, the fabric body 51 is provided at the rear of the second rotary brush 20, namely, on a side of the second rotary brush 20 opposite to the first rotary brush 10. Thus, the hermeticity of the space between the housing 30 and the floor surface can be increased and the dust can be efficiently scraped up by the second rotary brush 20.

Further, the fabric bodies 52 are provided respectively on the left and right sides of the suction port 32 of the housing 30, namely, on both sides of the suction port 32 in the direction of the rotation axes C1 and C2. Thus, the hermeticity of the space between the housing 30 and the floor surface can be further increased and the dust can be efficiently scraped up by the first rotary brush 10 and the second rotary brush 20.

Further, since the partition plate 35 is provided between the suction area 33 and the second rotary brush 20, the dust which is likely to be buried in the brush portion 22 of the second rotary brush 20 can be efficiently scraped up out of the brush portion 22.

Further, the angle θ formed by the straight line L1 connecting the rotation axis C2 of the second rotary brush 20 and the lowermost point of the second rotary brush 20 and the straight line L2 connecting the rotation axis C2 of the second rotary brush 20 and the tip end 35*a* of the partition plate 35 is larger than or equal to 90 degrees. Thus, the falling of dust from the fibers of the brush portion 22 of the second rotary brush 20 to the floor surface is prevented.

Further, since the arrangement density of the fibers of the brush portion 22 of the second rotary brush 20 is higher than the arrangement density of the fibers of the brush portion 12 of the first rotary brush 10, the dust can be efficiently scraped up by the fibers of the second rotary brush 20 arranged at high density.

Further, since the first rotary brush 10 and the second rotary brush 20 of the cleaner head 3 are rotated by the common motor 40, the configuration of the cleaner head 3 is simplified.

Second Embodiment

Figure 14:
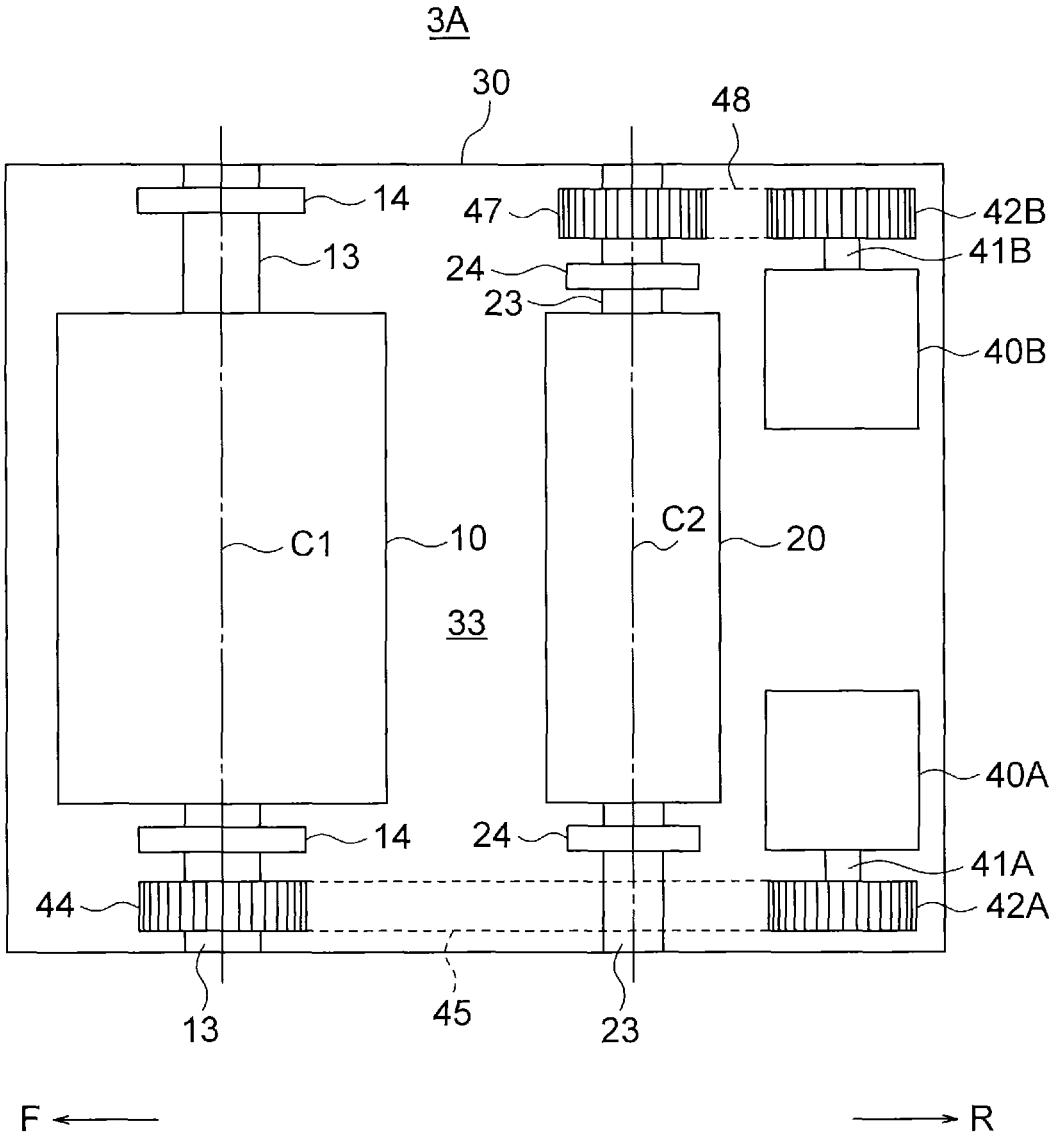
FIG. 14 is a diagram showing a two-dimensional arrangement of components of a cleaner head in a second embodiment.

Next, a second embodiment will be described. FIG. 14 is a diagram showing a two-dimensional arrangement of components of a cleaner head 3A in the second embodiment. In the first embodiment, the first rotary brush 10 and the second rotary brush 20 are rotated by the common motor 40. In contrast, in the second embodiment, the first rotary brush 10 and the second rotary brush 20 are respectively rotated by a first motor 40A and a second motor 40B.

Both of the first rotary brush 10 and the second rotary brush 20 are configured in the same manner as those in the first embodiment. However, instead of the gear 46 (FIG. 3), a pulley 47 is attached to the shaft 23 of the second rotary brush 20. The pulley 44 of the first rotary brush 10 and the pulley 47 of the second rotary brush 20 are located on sides opposite to each other in the widthwise direction of the cleaner head 3, that is, in the left-right direction.

Both of the first motor 40A and the second motor 40B are disposed at the rear of the second rotary brush 20. The first motor 40A and the second motor 40B are disposed so that their output shafts 41A and 41B are oriented in directions opposite to each other.

A pulley 42A is attached to the output shaft 41A of the first motor 40A. The timing belt 45 is stretched over the pulley 42A of the first motor 40A and the pulley 44 of the first rotary brush 10 in the same manner as that in the first embodiment.

Therefore, when the first motor 40A rotates, the first rotary brush 10 rotates in the same direction as the first motor 40A by means of the pulley 42A, the timing belt 45 and the pulley 44.

A pulley 42B is attached to the output shaft 41B of the second motor 40B. A timing belt 48 is stretched over the pulley 42B of the second motor 40B and the pulley 47 of the second rotary brush 20.

Therefore, when the second motor 40B rotates, the second rotary brush 20 rotates in the same direction as the second motor 40B by means of the pulley 42B, the timing belt 48 and the pulley 47.

In the second embodiment, the pulley 44 of the first rotary brush 10 and the pulley 47 of the second rotary brush 20 are located on sides opposite to each other in the left-right direction, and thus the configuration of the cleaner head 3A can be made close to a bilaterally symmetrical configuration. Therefore, it is possible, for example, to make the length of the second rotary brush 20 in the direction of the rotation axis C2 equal to the length of the first rotary brush 10 in the direction of the rotation axis C1.

Further, the load applied to each of the motors 40A and 40B is lower than the load applied to the motor 40 in the first embodiment, and thus each of the motors 40A and 40B can be made of a small-sized motor.

The cleaner head 3A in the second embodiment is configured in the same manner as the cleaner head 3 in the first embodiment except for the above-described features.

In the second embodiment, since the first rotary brush 10 and the second rotary brush 20 are respectively rotated by the first motor 40A and the second motor 40B, the cleaner head 3A can be configured to be bilaterally symmetrical, and the layout of the cleaner head 3A is facilitated.

Third Embodiment

Figure 15:
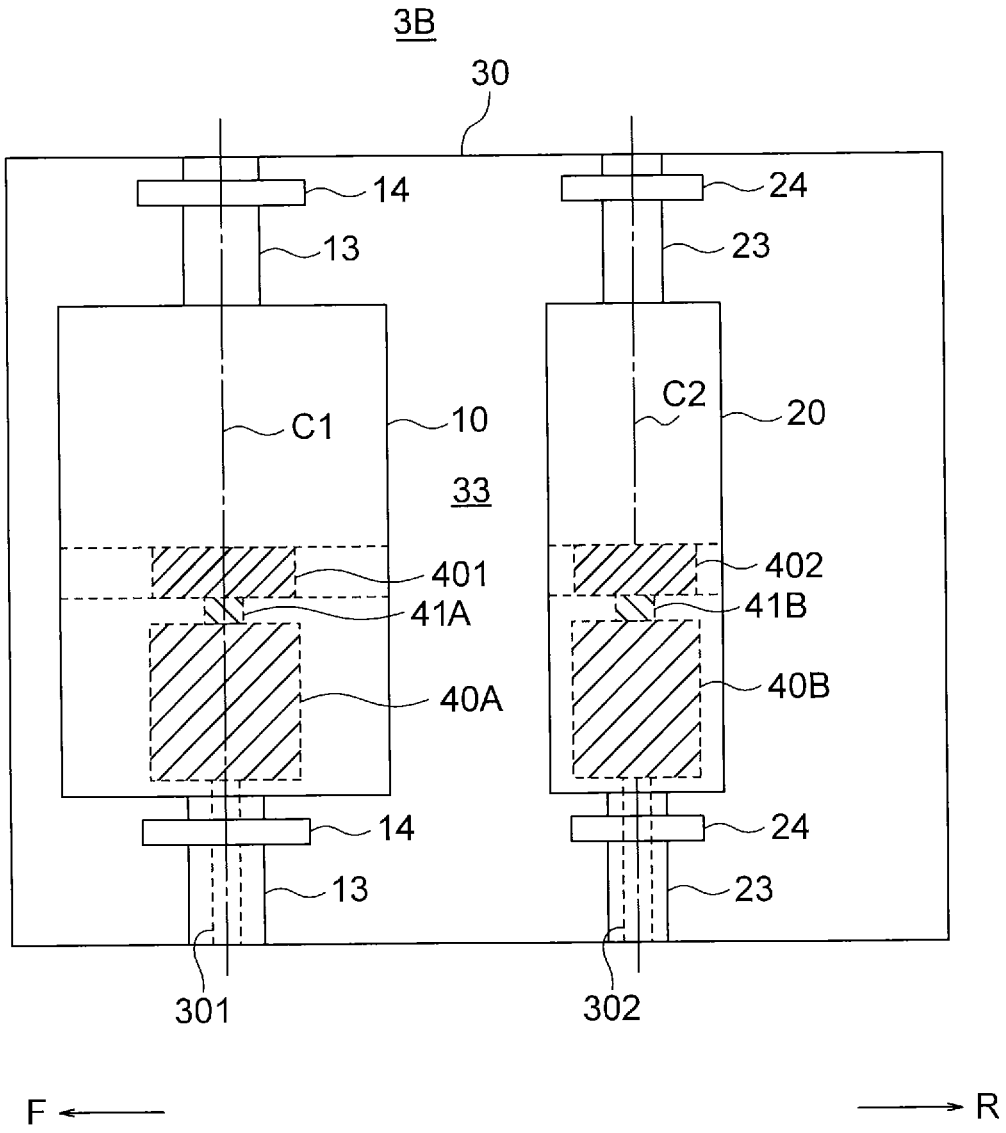
FIG. 15 is a diagram showing a two-dimensional arrangement of components of a cleaner head in a third embodiment.

Next, a third embodiment will be described below. FIG. 15 is a diagram showing a two-dimensional arrangement of components of a cleaner head 3B in the third embodiment. In the third embodiment, the first rotary brush 10 and the second rotary brush 20 respectively incorporate the first motor 40A and the second motor 40B.

The first rotary brush 10 is rotatably supported by the bearing portions 14 as described in the first embodiment. However, the pulley 44 is not attached to the shaft 13 of the first rotary brush 10.S The first rotary brush 10 includes a hollow portion inside the core portion 11 (FIG. 7(A)), and the first motor 40A is inserted in the hollow portion. A fitting portion 401 is attached to the output shaft 41A of the first motor 40A, and the fitting portion 401 is fitted into an inner circumference of the first rotary brush 10.S Further, the first motor 40A is fixed to the housing 30 by a support shaft 301 extending in parallel with the rotation axis C1 from the side wall of the housing 30. The support shaft 301 is inserted through the inside of the shaft 13 of the first rotary brush 10.

When the first motor 40A rotates, the fitting portion 401 attached to the output shaft 41A rotates, and the first rotary brush 10 fitted onto the fitting portion 401 rotates.

The second rotary brush 20 is rotatably supported by the bearing portions 24 as described in the first embodiment. However, the pulley 47 is not attached to the shaft 23 of the second rotary brush 20.

The second rotary brush 20 includes a hollow portion inside the core portion 21 (FIG. 7(B)), and the second motor 40B is inserted in the hollow portion. A fitting portion 402 is attached to the output shaft 41B of the second motor 40B, and the fitting portion 402 is fitted into an inner circumference of the second rotary brush 20.

Further, the second motor 40B is fixed to the housing 30 by a support shaft 302 extending in parallel with the rotation axis C2 from the side wall of the housing 30. The support shaft 302 is inserted through the inside of the shaft 23 of the second rotary brush 20.

When the second motor 40B rotates, the fitting portion 402 attached to the output shaft 41B rotates, and the second rotary brush 20 fitted onto the fitting portion 402 rotates.

The cleaner head 3B in the third embodiment is configured in the same manner as the cleaner head 3A in the second embodiment except for the above-described features.

In the third embodiment, since the first rotary brush 10 and the second rotary brush 20 respectively incorporate the first motor 40A and the second motor 40B, it is possible to achieve further downsizing of the cleaner head 3B in addition to the advantages described in the second embodiment.

Incidentally, while the vacuum cleaners 1 of the cordless type have been described in the first to third embodiments, the vacuum cleaner 1 is not limited to the cordless type. Further, the vacuum cleaner 1 is not limited to the upright type, but may be of a canister type, for example.

Further, while expressions such as forward, rearward, upward, downward, left and right have been used in the first to third embodiments, these expressions do not limit directions in regard to the cleaner head. For example, in the first to third embodiments, the first rotary brush 10 is described to be disposed forward and the second rotary brush 20 is described to be disposed rearward. However, it is sufficient that the second rotary brush 20 is provided on the same side as the communicating portion 36 connecting to the pipe 7 and the first rotary brush 10 is provided on a side opposite to the communicating portion 36.

While preferred embodiments of the present invention have been described specifically above, the present invention is not limited to the above-described embodiments and a variety of improvements or modifications are possible within the range not departing from the subject matter of the present invention.

What is claimed is:

1. A cleaner head comprising:

a housing having a suction port facing a cleaning target surface, the housing having a top portion on a side opposite to the cleaning target surface;

a first rotary brush provided in the housing;

a second rotary brush provided in the housing;

a suction area provided between the first rotary brush and the second rotary brush and connecting to the suction port;

a communicating portion provided on the top portion of the housing and connecting to a cleaner main body; and a partition plate disposed between the suction area and the second rotary brush in the housing, the partition plate being in contact with a second brush portion of the second rotary brush, wherein the first rotary brush and the second rotary brush rotate in directions opposite to each other.

2. The cleaner head according to claim 1, wherein the first rotary brush and the second rotary brush rotate in directions in which their outer circumferential surfaces facing the cleaning target surface approach each other.

3. The cleaner head according to claim 1, wherein the first rotary brush is disposed forward and the second rotary brush is disposed rearward in a traveling direction of the cleaner head, wherein the first rotary brush rotates in a direction in which its outer circumferential surface facing the cleaning target surface moves rearward, and wherein the second rotary brush rotates in a direction in which its outer circumferential surface facing the cleaning target surface moves forward.

4. The cleaner head according to claim 1, wherein the first rotary brush has a first shaft portion and a first brush portion attached to the first shaft portion, and wherein the second rotary brush has a second shaft portion and the second brush portion attached to the second shaft portion.

5. The cleaner head according to claim 4, wherein a diameter D1 of a maximum circle drawn by the first shaft portion when the first shaft portion rotates and a diameter D2 of a maximum circle drawn by the second shaft portion when the second shaft portion rotates satisfy D1>D2.

6. The cleaner head according to claim 1, wherein the housing has a contact portion that makes contact with the cleaning target surface and defines a reference surface, and wherein a distance H1 from the reference surface to a rotation center of the first rotary brush and a distance H2 from the reference surface to a rotation center of the second rotary brush satisfy H1>H2.

7. The cleaner head according to claim 1, wherein the first rotary brush and the second rotary brush project from the suction port to an outside of the housing.

8. The cleaner head according to claim 1, comprising a fabric body disposed on a side of the second rotary brush opposite to the first rotary brush.

9. The cleaner head according to claim 1, comprising fabric bodies respectively disposed on both sides of the suction port in a direction of rotation axes of the first rotary brush and the second rotary brush.

10. The cleaner head according to claim 1, wherein the partition plate and the communicating portion are disposed continuously with each other in a direction of suction airflow.

11. The cleaner head according to claim 1, wherein the partition plate extends in a rotating direction of the second rotary brush from a bottom portion of the housing facing the cleaning target surface, and wherein an angle formed by a straight line connecting a rotation center of the second rotary brush and a lowermost point of the second rotary brush and a straight line connecting the rotation center of the second rotary brush and a tip end of the partition plate is larger than or equal to 90 degrees.

12. The cleaner head according to claim 1, wherein an arrangement density of fibers of the second rotary brush is higher than an arrangement density of fibers of the first rotary brush.

13. The cleaner head according to claim 1, wherein the communicating portion is provided on a side of the top portion closer to the second rotary brush.

14. The cleaner head according to claim 1, comprising a motor that rotates the first rotary brush and the second rotary brush.

15. The cleaner head according to claim 14, comprising a pulley that couples the motor and the first rotary brush, wherein the motor and the first rotary brush rotate in the same directions.

16. The cleaner head according to claim 14, comprising a gear that couples the motor and the second rotary brush, wherein the motor and the second rotary brush rotate in directions opposite to each other.

17. The cleaner head according to claim 1, comprising:

a first motor that rotates the first rotary brush; and a second motor that rotates the second rotary brush.

18. The cleaner head according to claim 17, wherein the first motor is incorporated in the first rotary brush, and wherein the second motor is incorporated in the second rotary brush.

19. A vacuum cleaner comprising:

the cleaner head according to claim 1;

a cleaner main body having a dust collection container and a blower; and a pipe that connects the cleaner head and the cleaner main body.

20. The cleaner head according to claim 14, wherein the motor is incorporated in the first rotary brush or the second rotary brush.

* * * * *